United States Patent [19]

Heine et al.

[11] Patent Number: 5,055,333

[45] **Date of Patent: * Oct. 8, 1991**

[54] TUFTED CARPET

[75] Inventors: Richard F. Heine; Gene E. Thorp, both of St. Paul, Minn.

[73] Assignee: Minnesota Mining and Manufacturing Company, St. Paul, Minn.

[ * ] Notice: The portion of the term of this patent subsequent to Apr. 11, 2006 has been disclaimed.

[21] Appl. No.: 294,881

[22] Filed: Jan. 9, 1989

[51] Int. Cl.[5] ..... B32B 3/02; D03D 27/00; D04H 11/00

[52] U.S. Cl. ..... 428/88; 428/89; 428/92; 428/97; 428/212; 428/219

[58] Field of Search ..... 428/88, 89, 92, 97, 428/219, 212

[56] References Cited

U.S. PATENT DOCUMENTS

| | | | |
|---|---|---|---|
| 4,045,605 | 8/1977 | Breens et al. | 428/89 |
| 4,353,944 | 10/1982 | Tarui | 428/74 |
| 4,461,791 | 7/1984 | Matsui et al. | 428/15 |
| 4,546,020 | 10/1985 | Sakai et al. | 428/16 |
| 4,820,566 | 4/1989 | Heine et al. | 428/88 |
| 4,871,602 | 10/1989 | Luker | 428/88 |

*Primary Examiner*—Jenna Davis
*Assistant Examiner*—Terrel Morris
*Attorney, Agent, or Firm*—Gary L. Griswold; Walter N. Kirn; Richard Francis

[57] ABSTRACT

A tufted carpet having a backing which has thereon a plurality of first areas of tufts of fine denier fibers and a plurality of second areas of tufts of at least one looped, uncrimped, coarse denier fiber. Preferred patterns for the areas of tufts are alternating stripes or a checkerboard.

14 Claims, No Drawings

TUFTED CARPET

BACKGROUND OF THE INVENTION

1. Field of the Invention

The invention relates to tufted carpeting material, particularly carpeting material useful as an entry mat to remove dirt and water from shoes.

2. Background Art

Various devices have been employed at the entryways of buildings to reduce or remove the accumulation of various solid materials (hereinafter referred to merely as "dirt") and water typically found on the shoe soles and other pedestrian surface contacting parts of the shoe such as the heel (all of such parts hereinafter being referred to as the "shoe soles") of persons entering the building. Such devices typically include a mat which provides a brushing or wiping action against the shoe sole.

Such mats are generally fibrous or fabric in nature to provide the desired frictional surface and wiping action. Most fabrics or fibrous mats are not, however, completely satisfactory because they have a very limited capacity for storage of removed dirt and water and most are not particularly conducive to the rapid evaporation of water. They require frequent shaking and washing to rejuvenate the mats for subsequent uses.

Attempts have been made to provide floor mats which have a greater capacity for the storage of accumulated dirt, but these have generally been somewhat less than satisfactory. For example, lengths of solid materials such as edgewise oriented pieces of metal or segments of cut up automobile tires have been linked together, leaving spaces therebetween, to provide for the storage of dirt and other debris. Such mats, however, are not satisfactory because, besides being poor water absorbers, they leave the dirt removed plainly in view and they also require that the dirt be collected and removed after the mat is displaced since such mats generally have no bottom layer.

Some fabric or fibrous mats are unattractive and/or fail to provide a luxuriant underfoot surface. The more attractive and luxuriant mats are generally formed of very dense carpet pile, providing a surface with only a limited capacity for the storage of dirt and a structure from which water will be evaporated slowly.

Such carpet mats typically consist of a heavy backing attached to keep the mat in place upon which are deployed tufted fibers typically on the order of 6 to 15 denier per filament, a common fiber size for conventional carpeting material. While these fibers look good and have a pleasing texture when used in carpet, a mat of such conventional carpet fibers presents a rather closed surface which has little if any space to store and conceal dirt. Such a shortcoming gives rise to a phenomenon known in the entryway mat business as "retracking".

Retracking occurs when removed dirt on the surface of a mat such as tufted carpet with insufficient dirt storage space remains on the top of the mat and is picked up by the next person walking over the mat, causing the dirt to move further along on the mat until it is eventually carried into the building.

While mats containing larger denier fibers, such as those formed of coir (sometimes called "coco") fibers, fibrillated polypropylene film or large denier vinyl fibers, provide a sufficiently open mat to store dirt between such fibers, the large denier fibers are not very effective in absorbing and evaporating water.

U.S. Pat. No. 4,045,605 (Breens et al) discloses a carpeting material which includes pile or tuft fibers comprising 75 to 98% by weight of conventional carpet fibers and 2 to 25% by weight of stiff fibers or filaments arranged, not to provide openness to store removed dirt, but to act as dirt scrapers. The stiff fibers are not crimped. The conventional carpet fibers are less than 30 decitex per filament (about 27 denier) while the stiff fibers or filaments are of from 30 to 300 tex (about 270 to about 2700 denier). (The term "denier" refers to the weight in grams for a 9,000 meter fiber while the term "tex" refers to the weight in grams for a 1,000 meter fiber. Decitex is one-tenth of tex. A 0.11 tex fiber, or 1.1 decitex fiber would be 1 denier.) While Breens et al indicate that the stiff fibers may be fed in with each row of conventional pile or tuft yarn or in alternate rows or less frequently, using a conventional tufting machine or carpet loom, Breens et al also contemplate one or more rows of tufts of conventional carpet yarn followed by a row of stiff fibers or filament. Such an arrangement would not provide sufficient openness for the storage of removed dirt.

SUMMARY OF THE INVENTION

The present invention provides a tufted carpet mat which is particularly suited for pedestrian traffic. The mat of the invention may be advantageously used at the entryway of a building to wipe wet and/or dirty shoe soles. The mat of the invention overcomes many of the deficiencies noted above, providing a luxuriant, attractive, durable surface capable of wiping shoe soles, receiving, obscuring and holding therein dirt removed from shoe soles, wiping water from the shoe soles and facilitating evaporation of water.

Generally, the tufted carpet mat of the invention is comprised of a backing having thereon a plurality of first areas of tufts of fine denier fibers and a plurality of second areas of tufts of at least one looped, uncrimped coarse denier fiber. The second areas provide an open structure in the carpet mat which is capable of easily receiving and obscuring dirt therein. Single tufts of uncrimped coarse denier fiber(s) typically do not provide a structure having sufficient openness to receive and obscure dirt when surrounded by tufts of fine denier fibers. Thus, tufts of uncrimped coarse denier fiber(s) generally should be grouped together in areas separate from the areas containing tufts of fine denier fibers in order to provide areas having a sufficiently open structure to receive and obscure dirt. The relative proportion of tufts of coarse denier fiber(s) to tufts of fine denier fibers should be adjusted to provide sufficient wiping action and water absorbency, thought to be a function mainly of the tufts of fine denier fibers, and sufficient openness to collect and obscure collected dirt, the latter being a function mainly of the tufts of coarse denier fiber(s). Preferably, the areas of tufts of fine denier fibers separate the areas of tufts of coarse denier fiber(s) as in a checkerboard pattern or a pattern of alternate stripes of each area. Each of the areas is preferably at least about 2 mm in its smallest dimension, that being the approximate width of one row of tufts of a typical coarse denier fiber(s), to provide an adequate space for storage of dirt, but no more than 500 mm in its smallest dimension so that the shoe sole of a pedestrian will always contact both areas with each step. The preferred carpet has a checkerboard pattern with the areas being shaped substantially as rectangles, each area preferably being about 2 to 50 $cm^2$ in size.

The fine denier fibers preferably are about 15 to 50 denier per filament (dpf) and the coarse denier fibers are preferably about 150 to 5000 dpf. The total weight ratio of fine denier fibers to coarse denier fibers in the tufted carpet is preferably on the order of 1:3 to 3:1. The carpet preferably has a tufted pile face weight of at least about 600 grams per square meter and a pile height of at least about 0.5 cm.

The preferred pattern of fine denier and coarse denier areas is a checkerboard pattern or stripes with an area of coarse denier fibers being adjacent to an area of fine denier fibers in the checkerboard or the stripe pattern. The areas of tufts of fine denier fibers and the areas of tufts of coarse denier fiber(s) may be of the same height, but preferably the areas of tufts of coarse denier fiber(s) are of a lower height than the height of the tufts of fine denier fibers to provide depressions for collecting dirt directly over the tufts of coarse denier fiber(s). The collected dirt will then be received in the open spaces provided within the tufts of coarse denier fiber(s). The tufts of fine denier fibers provide a wiping action against the shoe sole which removes dirt therefrom.

The preferred carpet mat of the invention includes tufts of cut fine denier fiber and tufts of looped, uncrimped, coarse denier fiber(s). While the coarse denier fibers may be cut, it is preferred that they be uncut, thereby making the carpet mat easier to clean.

The fine denier carpet fibers are preferably nylon, acrylic, regenerated cellulose, wool, polyester, cotton or polypropylene fibers, or a mixture of two or more of these.

The coarse denier fibers may be formed of single component filaments or of two-component sheath/core filaments having a core of one material enclosed within a sheath of a second material. The core may be formed of a single filament or of a filamentous yarn. Preferably, the coarse denier fibers are single filaments of nylon, polyester or polypropylene, or sheath/core filaments having a filamentous nylon, polyester or polypropylene yarn core coated with a thermoplastic material such as polyvinyl chloride.

DETAILED DESCRIPTION

The tufted carpeting of the present invention may be produced by conventional carpet making equipment. A useful commercially available carpet making device may be obtained from Tufting Machine Division of TUFTCO Corporation of Chattanooga, Tenn. Tufting is a process whereby tufts of yarn are inserted into a backing material, called a "primary" backing, typically formed of woven or non-woven fabric. Yarn, as is well known, is a collection or a bundle of fibers of the appropriate size, in continuous or discontinuous lengths. The tufts of yarn are inserted by vertical, reciprocating needles similar to conventional sewing machines. A conventional tufting machine is like a giant sewing machine having hundreds of threaded needles held in a needle bar over a bed plate across the width of the machine. The needles receive the yarn from large beams or cones arranged in racks or a creel. The uncrimped coarse denier fibers are fed to spaced collections of needles on the needle bar which are spaced to produce spaced areas of tufts of the coarse denier fiber(s). Yarns of the fine denier fibers are fed to needle collections on the needle bar which occupy the space between the needles receiving the coarse denier fiber(s) to produce tufts of fine denier fibers between the tufts of coarse denier fiber(s), usually to cover the carpet surface with tufts to provide a continuous tufted area of separated areas of tufts of coarse denier fiber(s) and separated areas of tufts of fine denier fibers.

The yarns are tufted on the primary backing typically in side by side rows usually with at least two rows of tufts of the coarse denier fiber(s) being deployed between rows of the fine denier fibers. The simplest structure to produce is a matting with alternate stripes of tufts of coarse denier fiber(s) and fine denier fibers with stripes in straight lines along the entire length or width of the primary backing.

An alternative method involves forming an initial collection of tufts, much as one would do to produce a striped pattern, but then shifting the needle bar by employing a shifting bar to displace the row, typically displacing it about two tufts from its original path, starting a new striped pattern in the displaced location, then, after at least two tufts are made in the new location, shifting back to the original striped path, and repeating this shifting back and forth to produce a checkerboard pattern. Other variations are possible to obtain the tufted areas.

While it is possible to use a conventional carpet tufting machine to make a tufted carpet having alternate stripes of tufts of the coarse denier fibers and the fine denier fibers, such a tufting machine usually requires some alteration to make it suited for use to make a tufted carpet according to the present invention with a checkerboard pattern. This may be mechanically accomplished by the addition of a shifting cam. The shifting cam displaces the needles from an original tufting path to a path which is displaced from the original path, usually one or two tufts on one side or the other side of the original path, to make the checkerboard pattern.

The primary backing into which the yarns are inserted is usually supplied in roll form, typically located in front of the machine. Spiked rolls, typically positioned on the front and back sides of the tufting machine, draw the primary backing over the bed plate and through the machine. The speed of the spiked rolls controls the number of stitches per unit of length. Moving the primary backing slower produces more stitches per unit length while a faster rate produces fewer stitches per unit length.

Typically, located below the bed plate of the tufting machine are looper and knife combinations which pick up and hold momentarily the yarns carried by the needles. The loopers' work is timed with the stroke of the needles. When tufting cut pile, the looper and knife combinations hold and cut the yarns in a single operation. As the backing advances through the machine toward the cut pile loopers, the yarns picked up from the needles are cut with a scissor-like action between the back of the looper and knife cutting against the edge of the looper. Except for the selection of the type and the appropriately sized fibers and the production of tufted carpet with separate areas of tufts of coarse denier fiber(s) and areas of tufts of fine denier fibers, the tufting equipment and process are well known in the art.

The uncrimped coarse denier fibers used in the process of making the tufted carpet of the invention may be provided in the form of monofilaments or yarns. Such yarns are made up of a plurality of uncrimped coarse fibers, typically with about 10 to 20 fibers per yarn. Conventional tufting machines usually require that the coarse yarns be made up of continuous fibers for processability.

The fine denier fibers may be made of filaments which are either continuous or staple in yarn sizes that are commonly used to make conventional tufted carpet. The fine denier fibers are usually textured. Such conventional carpet yarns are typically on the order of about 6,000 denier with about 200 to 300 fibers per yarn.

The face weight is determined by yarn spacing (or machine gauge) as well as tuft length (pile height), yarn denier and stitch rate. If the pile height is too high, the fibers tend to lay over on themselves and could interfere with the dirt storage capacity. A pile height which is too high may also provide a tripping hazard. If the fiber or pile height is too low, the dirt hiding capacity is diminished. If the stitch spacing is too tight, the tufted carpet may not have sufficient openness for the storage of dirt.

Tufted pile height of at least 5 mm is preferred for adequate dirt hiding capacity and the tufted pile height should preferably not exceed 15 mm. The most preferred tufted pile height is on the order of 9 to 15 mm. Cleaning is also easier if the pile thickness is less than 15 mm. The primary backing is fabric which may be woven or non-woven and may be formed of natural or synthetic fibers. Preferred materials for forming the primary backing include the materials that are customarily employed for conventional carpet backing including, for example, natural fibers such as those made of jute or cotton, and synthetic fibers preferably those made of polyester or polypropylene. The preferred primary backing weight is on the order of 135 g/m$^2$. The fibers or filaments of the primary backing may be formed of slit film, extruded filaments or other conventional fibers formed in a conventional manner by any of a variety of processes. The primary backing may have needletacked to it a non-woven mat to provide a locking affect for the tufts and to prevent the backing material from unraveling. Such backings are well-known to those skilled in the carpet making art and this description is only given for purposes of illustration and to indicate that such conventional primary backings are useful in producing the tufted carpet of the present invention.

The tufted carpet of the present invention preferably includes a secondary backing which provides weight or body to the carpeting material to prevent it from being displaced as it is being walked over. The secondary backing is formed of conventional materials known for this purpose. The preferred secondary backings include those made of vinyl plastisol, polyurethene, rubber latex and similar materials. The secondary backing may be foamed, patterned such as in a waffle pattern, or ribbed. The secondary backing may also be filled with materials conventionally used in such backings for carpet mattings.

The tufts may be formed on the backing without utilizing a conventional tufting carpet machine. One way of forming the tufts in this manner is described in U.S. Pat. No. 3,943,028, the disclosure of which is incorporated herein by reference for a teaching of the preparation of a carpet without using a conventional tufting machine.

EXAMPLES

The invention is further illustrated by the following examples, wherein all parts are by weight unless otherwise specified.

EXAMPLES 1 AND 2

A conventional straight stitch cut pile tufting machine available from TUFTCO Corporation having a 9 to 13 mm pile height capability and equipped with a 5 mm (3/16 inch) gauge in-line needle bar having loopers but no knives was used to prepare carpet mats consisting of areas of looped tufts of fine denier fibers and areas of looped tufts of at least one uncrimped coarse denier fiber. Additionally, the tufting machine was equipped with a hydraulic shifting needle bar so as to be capable of producing a carpet having a checkerboard tuft pattern. Carpet mats were prepared by first making a multitude of "square" tufting stitches with a stitch spacing of 5 mm in a 135 g/m$^2$ woven primary backing formed of woven polypropylene slit film filaments having needletacked to it a polypropylene non-woven web. This primary backing is available under the trade designation "Polybac" FLW style 2483 from Amoco Fabrics Company. Then, the tufted primary backings were backed with a 2700 g/m$^2$ (80 oz. per square yard) filled vinyl plastisol as is commonly used on such walk-off mats. This plastisol consisted of about 32% mixed plasticizers, 36% vinyl acetate/polyvinyl chloride copolymer, 28% fillers and small amounts of surfactants and pigments. The plastisol secondary backing was formed by coating the plastisol on a carrier belt, laying and forcing the primary backing side of the carpet sample into the liquid plastisol and fusing the plastisol at 150° C. for about 10 minutes in a hot air oven.

EXAMPLE 1

The tufting machine needles were threaded in an "AAAABBBB" arrangement wherein four adjacent needles were threaded with a 6000 denier textured yard composed of 25 dpf polypropylene textured fine filaments (each needle threaded with fine filaments being referred to by "A"), the next four needles were threaded with a single, uncrimped, 0.762 mm (30 mil.) diameter sheath/core filament comprising a 1,000 denier polyester yarn core and a 4,000 denier polyvinyl chloride sheath (each needle threaded with coarse denier filaments being referred to by "B"), and repeating this sequence throughout the length of the needle bar. Eight rows of tufts were produced in sequence on an original path, each row having the AAAA, BBBB alternate sequence. The needle bar was then shifted to displace each needle path from the original path by two rows and a single row of tufts produced. The needle bar was again shifted to displace each needle path from the original path by a total of four rows and eight tufts produced on the new path. The needle bar was then returned to its original path in a reverse sequence, and the same sequence repeated to produce a checkerboard pattern of alternating rectangles 19 mm ($\frac{3}{4}$ inch) wide by 31.75 mm ($1\frac{1}{4}$ inch) long of 25 dpf yarn and 5000 dpf monofilament.

The tuft height was controlled by regulating the tension on the fine denier yarn and the coarse denier monofilament being supplied to the needle bar. By selectively adjusting and varying the tension under which the fine and coarse denier fiber was pulled to the primary backing, a carpet was made in which the tufts of coarse denier fiber were 1.6 mm (1/16 inch) lower than the tufts of fine denier fibers. The carpet so produced was passed under a reel type cutter called a tip shear which was adjusted to cut the looped tops of the 25 dpf yarn. This created the plush type appearance in the 25 dpf rectangles of a cut pile carpet. The carpet sample so produced had a total fiber face weight of 815 g/m$^2$, (24 oz. per square yard).

EXAMPLE 2

The tufting machine needles were threaded with 6000 denier textured yarn composed of 25 dpf polypropylene textured fine filaments (each needle threaded with fine filaments being referred to by "A") and 2400 denier yarn composed of eight 300 dpf uncrimped polypropylene coarse filaments (each needle threaded with coarse filaments being referred to by "B") in an AAAA, BBBB sequence. The carpet sample was made without shifting the needle bar and a striped pattern, comprising four rows of looped tufts of fine denier fibers and four rows of looped tufts of uncrimped coarse denier fibers in an alternating pattern, was obtained. The carpet sample so produced had tufts of coarse and fine denier fibers of equal height and a total fiber face weight of 915 g/m$^2$ (27 oz. per square yard).

Control Example 1

Control Example 1 was a 6.3 mm ($\frac{1}{4}$ inch) cut pile tufted carpet mat consisting of an approximately equal mixture of 10, 20 and 30 dpf polypropylene fibers and having a total fiber face weight of 680 g/m$^2$ (20 oz. per square yard).

Water Absorption Test

Each of the example carpets were tested to determine the amount of water each would absorb from the shoe sole of the test foot in a Water Absorption Test.

The test device was originally built as a wear tester for deck covering according to Mil-D-16651D. The test device includes a 380 mm diameter horizontal turntable which is rotated at about 23 revolutions per minute beneath a vertically movable shaft with its longitudinal axis deployed 130 mm from the axis of rotation of the turntable. Affixed to the end of the shaft closest to the surface of the turntable by two recessed bolts is a 50 mm diameter "foot" made of 3 mm thick tanned shoe sole leather. As the turntable rotates, the shaft lifts the foot approximately 12 mm from a rest position above the turntable surface whereupon it is released to drop back or "step" on the turntable surface at the rate of six times per revolution or 138 times per minute. The combined weight of the shaft and foot was 1.7 kg. On the turntable surface are mounted and restrained two split annular carpet samples, each defined by a half annulus with a 400 mm outside radius and a 130 mm inside radius. The two half annuli are clamped to the turntable by an inner retaining ring and a thin metal strap which bridged the gap between the half annuli. One of the half annuli carpet samples is fully saturated with water to provide a wet surface from which the shoe will pick up water. The other half annulus is the test sample which is weighed dry prior to the test.

The half annulus sample which is saturated with water was available from the Minnesota Mining and Manufacturing Company under the designation All Weather "Nomad" mat. Water is added to this mat to fully saturate it until water is observed at the surface of the mat. The equipment is tested to determine adequate performance by using as the other half annulus test carpet another sample of All Weather "Nomad" matting. The equipment is run for 100 revolutions or cycles whereupon it was stopped, additional water is added to the saturated mat, and this sequence repeated, adding additional water after each 100 cycles until 500 cycles have been completed. The initially dry test sample is then reweighed, its dry weight is subtracted from its wet weight and the weight in grams reported. The water pickup for the All Weather "Nomad" mat typically is on the order of 62.5 to 66.5 grams for an average of 64.5 grams with the standard deviation of about 2 grams.

Water absorption test results for Examples 1-2 and Control Example 1 are given in Table I.

TABLE I

| Example | Water Absorbed (g) | Face Weight g/m$^2$ |
|---|---|---|
| 1 (check) | 86 | 815 |
| 2 (stripe) | 85 | 915 |
| Control 1 | 59 | 680 |

It was surprising to note that the amount of water absorbed by the carpet of the invention, Examples 1 and 2, was greater than Control example 1. This was completely unexpected since it was thought that the amount of water absorbed by Control 1 would be greater.

Dirt Removal Test

Examples 1 and 2 and Control Example 1 were also tested for dirt removal and dirt trapping. A 1.5 m long by 0.9 m wide test mat of each Example was placed at a building entrance for a period of two weeks. Each mat was vacuumed twice a week and the weight of the dirt collected was measured and recorded. Additionally, the mats were weighed before and after the test to determine the weight of any residual dirt remaining in the mat. The results of the dirt trapping test are shown in Table II.

TABLE II

| Example | Dirt Trapped (g) |
|---|---|
| 1 | 326 |
| 2 | 301 |
| Control 1 | 150 |

From Tables I and II, it can be seen that mats having looped tufts of uncrimped coarse denier fiber(s) in areas separate from areas containing tufts of fine denier fibers are superior to conventional cut pile mats of fine denier fibers in both water absorbtion and dirt trapping ability.

Both of the Examples made according to the present invention had better performance than a control carpet sample consisting entirely of fine denier polypropylene cut pile fibers such as is commonly used by the trade.

In sum, it has been found that incorporation of areas of looped uncrimped coarse denier fibers in patterns with areas of fine denier carpet fibers produces a walk-off mat with superior water absorbing and holding capabilities.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A tufted carpet comprising a backing having thereon a plurality of first areas of tufts of the fine denier fibers and a plurality of second areas of tufts of at least one looped, uncrimped, coarse denier fiber, said tufts of coarse fiber being grouped together to provide openness in said carpet, wherein said openness is capable of easily receiving and obscuring dirt therein.

2. The tufted carpet of claim 1 wherein the fibers comprising the tufts of said fine denier fibers are looped.

3. The tufted carpet of claim 1 wherein said tufts of said looped, uncrimped, coarse denier fiber(s) are shorter than the tufts of fine denier fibers.

4. The tufted carpet of claim 1 wherein each of said areas is from about 2 mm to about 500 mm in its smallest dimension.

5. The tufted carpet of claim 1 wherein said fine denier fibers are about 15 to 50 dpf and said uncrimped, coarse denier fibers are about 150 to 5000 dpf, and the weight ratio of said fine denier fibers to said coarse denier fibers is about 1:3 to 3:1.

6. The tufted carpet of claim 1 wherein said carpet has a tufted pile face weight of at least about 500 grams per square meter and a pile height of at least about 5 mm.

7. The tufted carpet of claim 1 wherein said fine fibers are formed from a material selected from the group consisting of nylon, acrylic, regenerated cellulose, wool, polyester, cotton and polypropylene.

8. The tufted carpet of claim 1 wherein said coarse fibers are single component filaments formed from a material selected from the group consisting of nylon, polyester and polypropylene.

9. The tufted carpet of claim 1 wherein said coarse fibers are two-component sheath/core filaments comprising a filamentous yarn core formed from a material selected from the group consisting of nylon, polyester and polypropylene, and a polyvinyl chloride sheath.

10. The tufted carpet of claim 1 wherein said areas are in a checkerboard pattern.

11. The tufted carpet of claim 1 wherein said areas are continuous parallel stripes.

12. The tufted carpet of claim 1 wherein said areas are about 2 to 50 $cm^2$ in size.

13. The tufted carpet of claim 1 wherein said tufts of coarse denier fiber are formed of a single loop of coarse denier monofilament.

14. Tufted carpet comprising a backing having thereon a plurality of first areas of tufts of fine denier fibers and a plurality of second areas of tufts of at least one looped, uncrimped, coarse denier fiber, the tufts of looped, uncrimped coarse denier fiber(s) being shorter than the tufts of fine denier fibers, each of said areas being from about 5 mm to about 100 mm wide and being grouped together to provide openness in said carpet, said fine denier fibers being about 15 to 50 dpf, said coarse denier fibers being about 150 to 5000 dpf, the weight ratio of said fine denier fibers to said coarse denier fibers being about 1:3 to 3:1, said tufted carpet having a tufted pile face weight of at least about 500 grams per square meter and a fine denier pile height of at least about 5 mm.

* * * * *

UNITED STATES PATENT AND TRADEMARK OFFICE

CERTIFICATE OF CORRECTION

PATENT NO. : 5,055,333

DATED : October 8, 1991

INVENTOR(S) : Richard F. Heine and Gene E. Tharp

It is certified that error appears in the above-identified patent and that said Letters Patent is hereby corrected as shown below:

On the title page: under [75] Inventors, "Gene E. Thorp" should read --Gene E. Tharp--.

Column 8, line 67, "of the fine" should read --of fine--.

Signed and Sealed this

Twelfth Day of October, 1993

*Attest:*

*Attesting Officer*

Bruce Lehman

BRUCE LEHMAN

*Commissioner of Patents and Trademarks*